US008703241B2

(12) United States Patent
Bottanelli

(10) Patent No.: US 8,703,241 B2
(45) Date of Patent: Apr. 22, 2014

(54) SURFACE PREPARATION OF STEEL PARTS FOR BATCH HOT-DIP GALVANIZING

(75) Inventor: Ugo Bottanelli, Solero (IT)

(73) Assignee: Setra S.R.L., Alessandria (IT)

( * ) Notice: Subject to any disclaimer, the term of this patent is extended or adjusted under 35 U.S.C. 154(b) by 217 days.

(21) Appl. No.: 13/126,025

(22) PCT Filed: Oct. 23, 2009

(86) PCT No.: PCT/IT2009/000477

§ 371 (c)(1),
(2), (4) Date: Apr. 26, 2011

(87) PCT Pub. No.: WO2010/049965

PCT Pub. Date: May 6, 2010

(65) Prior Publication Data

US 2011/0195191 A1 Aug. 11, 2011

(30) Foreign Application Priority Data

Oct. 28, 2008 (IT) ..... AL2008A0020

(51) Int. Cl.
*C23C 18/48* (2006.01)

(52) U.S. Cl.
USPC ..... 427/310; 427/406; 427/430.1; 427/328; 427/405

(58) Field of Classification Search
USPC ..... 427/310
See application file for complete search history.

(56) References Cited

U.S. PATENT DOCUMENTS

| | | | | |
|---|---|---|---|---|
| 6,200,636 | B1 * | 3/2001 | van Ooij et al. | 427/313 |
| 6,221,431 | B1 | 4/2001 | Bisol et al. | |
| 6,248,122 | B1 | 6/2001 | Klumb et al. | |
| 6,270,842 | B1 | 8/2001 | Uchida et al. | |
| 6,372,296 | B2 | 4/2002 | van Ooij et al. | |
| 6,921,543 | B2 | 7/2005 | Rudenko et al. | |
| 2006/0228482 | A1 | 10/2006 | Memmi et al. | |

FOREIGN PATENT DOCUMENTS

| | | | |
|---|---|---|---|
| EP | 1 466 029 | B1 | 7/2006 |
| EP | 1 352 100 | B1 | 11/2006 |
| IT | RM2002A000589 | | 11/2002 |
| IT | RM2005A000006 | | 1/2005 |
| JP | 2005-117835 | | 4/2005 |
| WO | 03/057940 | A1 | 7/2003 |
| WO | 2007/071039 | A1 | 6/2007 |

OTHER PUBLICATIONS

Authorized Officer Hoyer, Wolfgang, "International Search Report," International Application No. PCT/IT2009/000477, European Patent Office (3 pages), Date of mailing Jan. 29, 2010.
Authorized Officers Baharlou, Simin and Hoyer, Wolfgang, "International Preliminary Report on Patentability, Written Opinion of the International Search Authority," International Application No. PCT/IT2009/000477, European Patent Office (6 pages), Date of mailing May 3, 2011.

* cited by examiner

*Primary Examiner* — Timothy Meeks
*Assistant Examiner* — Nathan T Leong
(74) *Attorney, Agent, or Firm* — Stetina Brunda Garred & Brucker

(57) ABSTRACT

This innovation is relevant to a surface preparation of prefabricated steel parts, able to guarantee an excellent contact between the surface to be coated, and the molten bath, based on a Zinc-alloy containing Aluminum between 0.01 and 0.1 wt %. In a greater detail this invention is related to a procedure for hot-dip coat steel parts with a Zn—Al-alloy, according to which the parts are properly pickled and then immersed into an aqueous flux solution containing $ZnCl_2$, $NH_4Cl$, $Bi_2O_3$, and KCl, at a pH between 0.1 and 1.5 and a temperature in the range 4 and 50° C., for an immersion time between 10 s and 10 minutes. Using the flux solution according to the present innovation, it is possible to coat discontinuously with a Zn—Al-alloy, parts fabricated either with plain Carbon steels either high-strength steels. Furthermore, steels known commercially as Sandelin or Iper-sandelin, may be also coated without surface defects and with a glossy appearance.

10 Claims, No Drawings

SURFACE PREPARATION OF STEEL PARTS FOR BATCH HOT-DIP GALVANIZING

CROSS-REFERENCE TO RELATED APPLICATIONS

The present application claims priority to International Application No. PCT/IT2009/000477 which was filed on Oct. 23, 2009 and claims priority to Italian Provisional Patent Application No. AL2008A000020 filed Oct. 28, 2008.

STATEMENT RE: FEDERALLY SPONSORED RESEARCH/DEVELOPMENT

Not Applicable

BACKGROUND

The present invention has as object an improvement of the surface preparation of the steel parts, to be hot-dip galvanized and, more specifically, it refers to the application mode of the flux solution, for batch hot dip galvanizing processes, containing up to 0.1 wt % of aluminium. The choice of the chemical composition of the flux solution, together with its specific best mode, ensure an improved wetting of the fabricated steel parts during the immersion in the molten alloy and ensure an uniform and adherent coating to the substrate (cold and/or hot rolled steel).

It is known since long time that it is possible to improve certain performances, for example the oxidation resistance and more generally the corrosion resistance of fabricated parts, particularly with steel, by coating with metals such as Zinc, Cadmium, Aluminium or their alloy. Among the various type of coatings, particularly interesting are those based on the Zn—Al alloys, for their superior resistance in several aggressive environment, for their good mechanical characteristics and for their good surface appearance. Generally, metal coatings, may be obtained by immersion of parts into a molten metal bath or by electrolysis, in both: continuous or discontinuous processes.

Currently, batch processes are primarily dedicated to products of limited size, as for example screws, bolts, steelwork and the likes, even if they can be applied also for products of larger dimensions. However, the trend is for continuously coat parts of undefined size, such as strips, rods and wires, and then transform them in the final products, for example by cutting and cold drawing the strip.

However, these products have some drawbacks, for example have cut edges, without the protective coating, and so less resistant to the attack in aggressive environments; these drawbacks, because of the increasing demand of the market for high quality products, begin to overcome the benefit offered by the continuous coating processes. Therefore the interest for discontinuous coating processes, applied to fabricated parts, such as spars, brackets, and similar for cars, for shipbuilding, for appliances, etc., is increasing.

Obviously, there is also great interest for the discontinuous coating process of steel parts with Zinc-Aluminium alloys which, as mentioned above, have more high-temperature oxidation resistance and more corrosion resistance in several aggressive media.

However, so far it is very difficult to obtain good hot-dip coatings with Zinc-Aluminium alloys, as to make, also for batch processes, the surface preparation of the steel parts at high temperature in an hydrogen atmosphere, typical of continuous galvanizing, is expensive and impractical. Nonetheless the usual flux solution, based on an aqueous solution containing Zinc plus Ammonium chlorides, lose its effect, when the concentration of Aluminium, in the molten bath, exceeds 0.01 wt %

Steel parts, badly pre-treated, are not properly wetted by the molten alloy during hot-dip, and the final coating will have black-spots and un-coated areas. It is worthwhile to recall briefly here, the scope of the fluxing pre-treatment before hot-dip galvanizing. The pre-treatment should remove all residual oxidation from the surface of the steel parts, also after acid pickling and would protect the surface, during immersion into the molten bath. The flux reacts with the Zn-alloy at 450° C. producing reducing gaseous components which protect against oxidation and are readily removed.

However, Al, already at very low percentages in the Zn-based alloy-bath, reacts as mentioned above, producing stable compounds, mainly oxides, which sticks on the surface and do not allow good wettability of the steel parts by the molten alloy, producing extended surface defects.

Many attempts have been made for the set-up of a robust batch process for Zn—Al-alloy coatings.

The U.S. Pat. No. 6,270,842 proposes a new flux composition, including NaCl and/or alkaline metals and NaF, to be used in batch coating processes for steel parts with Zn—Al.

The U.S. Pat. No. 6,221,431 proposes a new flux composition containing a mixture of salts of the cations: Ni, Al, K, and Mn for coating fabricated parts with so-called reactive steels.

A non conventional route is instead put forward by the U.S. Pat. Nos. 6,200,636 and 6,372,296, which refer to the chemical deposition of thin layer of metals, 5 to 50 nm thick, plated electroless, on a steel part, before hot-dip galvanizing into Zn-based or Zn—Al-alloys. The selected metals are: Sn, Cu, Ni, Co, Mn, Zr, Cr, Pb, Hg, Au, Ag, Pt, Pd, Mo, alone or in combination to each other.

The molten bath is either pure Zinc or a Zn—Al-alloy, containing Al up to 40%.

In the Japanese patent JP 05-117835, $BiCl_3$ or $SnCl_2$ or an alcohol, are added to the flux solution containing $ZnCl_2$-$NH_4Cl$, for Zn—Al coatings with Al between 0.001 and 20 wt %. It is also stated that it is not possible to flux wet steel parts and it is proposed a method for rapid drying the fabricated part after flux through controlled additions of a volatile aliphatic alcohol.

The U.S. Pat. No. 6,248,122 is relevant to the deposition of a continuous thin metallic film, followed by the immersion of the part into HCl before the hot-dip immersion into a Zn—Al molten alloy; the thus formed chloride would melt and facilitate the metal film to dissolve into the molten bath. The metallic film would protect the steel part surface against oxidation, which may cause defects on the final ZnAl coatings.

In the U.S. Pat. No. 6,921,543 the suggested composition of the flux is: 60-80 wt % $ZnCl_2$, 7-20 wt % $NH_4Cl$, 7-20 wt % of at least one alkaline or alkaline-earth salt, 0.1-0.5 wt % of a compound selected among $NiCl_2$, $CoCl_2$, $MnCl_2$ and 0.1-1.5 wt % of at least one compound selected among $PbCl_2$, $SnCl_2$, $BiCl_3$, $SbCl_3$. Furthermore it is stated that the percentage of $ZnCl_2$ is ranging between 70 and 78 wt % and that of $NH_4Cl$ between 11 and 15 wt %. The total salts dissolved into water is in the range 200-700 g/L, preferably 500-550 g/L. The molten Zn-bath contains Al between 0 and 56 wt %.

In the text it is clearly stated that: 1) the flux after drying is deposited on the surface of the parts; 2) the suggested quantities of $ZnCl_2$ form a continuous film, on the surface to be galvanized; 3) the $NH_4Cl$ attacks the surface of the parts eliminating the residual rust or similar; 4) the chlorides of the alkaline, alkaline-earth, Lead, Tin, Bismuth, and Antimony metals, improve wettability of the part when immersed into the molten alloy. It is worth noting that in the examples in the text, the quantity of Al in the molten bath is not less than 4.2 wt %. This US patent corresponds to the EP 1 352 1000.

The EP 1 466 029, is relevant to the surface preparation before hot-dip galvanizing of steel parts cleaned in order to achieve a pollution level inferior to 0.6 μg/cm2; the cleaning treatment is followed by the immersion of the parts into a flux solution containing a soluble Bi salt which forms a protective layer. When the galvanizing bath is "galfan", in order to achieve good results, the flux must guarantee the formation of a thin protective metallic layer on the steel part. In Claim 6 the flux must be an aqueous solution containing 0.3-2 wt % of Bi (as soluble salt, oxide, chloride, etc.). In Claim 11 the molten Zn-based bath must contain at least 0.15 wt % Al.

In the Italian Patent RM02A0589 the aqueous flux solution must contain 5-300 g/L of NH4Cl, 90-100 g/L of ZnCl2, 1-20 g/L of Bi chlorides, preferably in the following order: 10-150, 100-200, 1-10 g/L. This flux solution is able to plate a metallic layer (Bismuth), on the surface, whose thickness is between 1 nm and 1 μm. The flux solution may contain H3BiO4 and the galvanizing bath may contain 0.001-0.1 wt % Al.

The Italian patent RM05A0006 restricts the composition range of the flux: 10-1050 g/L NH4Cl; 80-270 g/L ZnCl2; 0.5-10 g/L BiCl3; 1-10 g/L CuCl2. The pH of the solution should be 1.8-2.3 corrected with HCl or NaCl. To the flux solution may be added: KCl (2-50 g/L, preferably 3-6 g/L) and/or SnCl2 (2-7 g/L, preferably 4-6 g/L or more preferable 3-5 g/L). The flux solution may also contain Bismuth oxide (1-16 g/L).

At last the international patent application WO 07/071039 (equivalent to the U.S. patent application Ser. No. 07/0,137,731) in which the aqueous flux solution contains 15-40 wt % ZnCl2; 1-10 wt % NH4Cl; 1-6 wt % of an alkaline-metal chloride; 0.02-0.15 wt % of a non-ionic surfactant, containing polioxy-ethylene alcohols, with a ratio between hydrophilic/lyophilic<11, brought to pH≤1.5 with the addition of an acid. The flux contains FeCl3 (1-4 wt %) and/or 0.05 wt % Bi2O3.

None of the techniques described above are satisfactory, as far as applicability, safety or environment. As an example, the use of an alcohol in a hot-dip galvanizing shop, where some of the process operations occur at high temperature, is not appropriate, for the fire danger and the gaseous emissions. Furthermore, the use of fluorides is not acceptable, being them dangerous for the environment and because of the high cost of exhaust disposal.

The innovation, based on the chemical deposition of a thin metallic film on the surface of the steel parts, followed by conversion in HCl, is costly as it introduces into the process an additional stage and it is not robust enough, as it depends on the reaction with HCl which is affected by residual surface pollution.

Furthermore, in the most recent Patent literature, the immersion time and the temperature of the flux solution are not mentioned, nevertheless it has been found they are very important when associated with the pH and to the flux concentration.

In any case, the batch coating process with Zn—Al-alloys present always many difficulties, caused primarily to surface cleanliness which should be maintained clean until immersion into the molten bath; this leads to coating defects, such as rough surfaces, poor adherence, black-spots, etc.

BRIEF DESCRIPTION OF THE DRAWINGS

Not Applicable

DETAILED DESCRIPTION

The present invention aims at the solution of the problems mentioned above, suggesting a refined procedure for the surface preparation of steel parts, including a new mode for the application of the flux, able to form on the surface, which will be subsequently galvanized, a saline precipitate containing Bismuth (either metallic or oxidised). This, being able to guarantee an excellent contact between the surface to be galvanized and the molten Zn-bath (between 400 and 530° C.), containing Al in the range 0.01-0.1 wt %.

Furthermore, according to the present invention, a refined procedure for surface preparation has been discovered, able to hot-dip coat with a Zn—Al-alloy, steel fabricated parts. These, after pickling, are immersed into an aqueous solution containing: 50-300 g/L ZnCl2; 20-300 g/L NH4Cl; 0.1-1 g/L Bi2O3; 10-100 g/L KCl, at a pH within 0.5 and 1, maintained into the optimum range with HCl or KOH 0.1N, at a temperature in the range 4-50° C., preferably between 10 and 30° C. and more preferable between 15 and 25° C., for 10-30 minutes, preferably between 20 seconds and 2 minutes, but more preferable between 30 seconds and 1 minute.

This procedure for surface preparation of steel components will guarantee the precipitation of a saline layer, whose weight is between 3-7 g/m2.

After immersion of the steel parts, into the flux solution, these are dried at 60-120° C. for 60 minutes, maximum. The adherent saline precipitate, will protect the steel parts against oxidation, have a melting temperature well inferior to that of the molten bath and therefore are transformed into ash and dross when the parts are hot-dip.

Using the flux solution described in the present invention it is possible to coat with a batch process, using Zn—Al-alloys, steel parts, either fabricated with plain Carbon or High-strength steels.

Steel containing high Si, and/or Mn, and/or P (i.e. those types commercially known as Sandelin or Ipersandelin steels), usually not suitable for galvanizing, may be successfully galvanized by means of the flux solution described in the present invention, which allow the formation of constant thickness coatings, with no surface defects, having a glossy surface without rough or inhomogeneous zones.

The following Examples demonstrate certain preferred embodiments of the present invention, without in any way limiting the scope and objects of the invention.

Example 1

The chemical composition of the innovative flux solution and its operative best mode, are listed in Table 1, while in Table 2 are shown the composition and the application parameters of a conventional flux solution, used as a control. Steels have been galvanized, using both flux solutions, with the following procedure:

a. degreasing into a commercial acid 10 wt % solution, at room temperature, for 10 minutes;

b. tap water rinsing;

c. HCl 10 wt % pickling, at room temperature, for 15 minutes;

d. Tap water rinsing;

e. Flux, according to the procedure of Table 1 & 2;

f. Drying at 80° C. in air;

g. Immersion into a molten Zn-0.03 wt % Al-alloy at 450° C.

TABLE 1

| Chemical composition of the innovative flux solution | | | | | | | |
|---|---|---|---|---|---|---|---|
| Composition (g/L) | | | | | Application parameters | | |
| | | | | | time | T | Acidity |
| $ZnCl_2$ | $NH_4Cl$ | $Bi_2O_3$ | KCl | $FeCl_2$ | (min) | (° C.) | (pH) |
| 184 | 144 | 0.2 | 65 | 10 | 1.0 | 20 | 0.8 ÷ 1.0 |

TABLE 2

| Chemical composition of the control flux solution | | | | | | |
|---|---|---|---|---|---|---|
| Composition (g/L) | | | | Application parameters | | |
| | | | | time | T | Acidity |
| $ZnCl_2$ | $NH_4Cl$ | KCl | $FeCl_2$ | (min) | (° C.) | (pH) |
| 184 | 144 | 65 | 10 | 3 | 20 | 3.3 |

The composition of the steels used in this experiment, is listed In Table 3.

TABLE 3

| Chemical analysis of the steels used in the experiments | | | | | | |
|---|---|---|---|---|---|---|
| | C | Si | Al | Mn | P | S |
| Plain carbon steel | 0.040% | 0.10% | n.a. | 0.43% | 0.009% | 0.015% |
| High strength steel (high Mn) | 0.16% | 0.01% | 0.04% | 1.49% | 0.01% | 0.01% |
| Reactive steel (high Si) | 0.09% | 0.17% | 0.051% | 0.54% | 0.01% | 0.004% |
| HSS 355 | 0.05% | 0.07% | 0.045% | 0.61% | 0.01% | 0.008% |

The adherence of the saline precipitate on the surfaces, after flux, has been assessed extracting, from a standard area of surface, the saline precipitate, by means of an adhesive tape, according to the scale of merit, shown in Table 4.

TABLE 4

| Empirical scale of merit for the adherence of the saline precipitate after immersion into the flux solution. | |
|---|---|
| % extracted of saline precipitate by means of an adhesive tape. | Vote |
| ≥20 | Very bad |
| 10 ÷ 20 | Bad |
| 5 ÷ 10 | Fair |
| 1 ÷ 5 | Good |
| 0 ÷ 1 | Excellent |

The best adhesion of the saline precipitate was obtained in a flux solution maintained at 0.5<pH<1, for 1-2 minutes into, within the temperature range: 5-45° C. In these conditions, the optimum Bi precipitated on the steel surfaces varies between 0.035 and 0.055 g/m2.

Example 2

Two identical series of steel parts, having the chemical compositions listed in Table 3, fluxed according the procedure shown in Tables 1 & 2, have been hot-dip galvanized in the same conditions into a molten bath of Zn-0.03 wt % Al-alloy (Iron saturated). The quality of the coated surfaces is then ranked visually, according to the empirical scale of Table 5. Results are shown in the following Table 6.

When the innovative flux solution is used, the final product results to be much more aesthetically shining, with no rough or inhomogeneous zones.

TABLE 6

| Quality of coated surfaces with a Zn-0.03 wt % Al-alloy | | | | |
|---|---|---|---|---|
| | Control flux solution (see. Table 2) | | Innovative flux solution (see Table 1) | |
| | Pin-point defects | Not-coated area | Pin-point defects | Not-coated area |
| Plain carbon steel | ○ | ○ | ⊙ | ⊙ |
| High strength steel (high Mn) | ■ | ⊠ | ○ | ⊙ |
| Reactive steel (high Si) | □ | ○ | ⊙ | ⊙ |
| HSS 355 | ■ | ⊠ | ⊙ | ⊙ |

TABLE 5

| Surface quality of coatings | |
|---|---|
| Vote | Ranking |
| ■ | Very bad |
| ⊠ | Bad |
| □ | Fair |
| ○ | Good |
| ⊙ | Excellent |

TABLE 7

| Quality of Zn-0.03 wt % Al-alloy coated parts, fabricated with a plain Carbon steel vs. time, temperature and pH of the innovative flux solution (see Table 1) | | | | |
|---|---|---|---|---|
| Time (min) | T ° C. | pH | Quality assessment (visual) | % extracted of saline precipitate by means of an adhesive tape. |
| 0.5 | 26 | 0.8 | ⊙ | 0 ÷ 1 |
| 1.1 | 4 | 0.7 | ⊙ | 0 ÷ 1 |
| 2 | 25 | 0.9 | □ | 5 ÷ 10 |
| 3 | 6 | 1.6 | □ | 5 ÷ 10 |
| 2.5 | 20 | 2.2 | ⊠ | 10 ÷ 20 |
| 1.0 | 45 | 1.0 | ⊙ | 0 ÷ 1 |

Example 3

The Si & P content of various steels used here, are listed in Table 8, while in Table 9, the composition of various flux solutions and relevant application conditions, before hot-dipping into pure Zn or Zn-0.03 wt % Al at 443° C. for 5-9 minutes, are indicated.

The procedure adopted here for surface preparation of steels, is the same as that of Example 1.

TABLE 8

Chemical composition of steels, used in the Example 3

| Steel grade | Si | P |
|---|---|---|
| Sandelin | 0.10 | 0.009 |
| Iposandelin | 0.01 | 0.014 |
| Iper-sandelin | 0.167 | 0.027 |

TABLE 9

Chemical composition (g/L) of several flux solutions, used at 25-30° C. for 1 minute of immersion time.

| Flux type | $ZnCl_2$ | $NH_4Cl$ | $Bi_2O_3$ | KCl |
|---|---|---|---|---|
| A | 225 | 75 | 0.19 | — |
| B | 150 | 50 | 0.23 | 46 |
| C | 150 | 50 | 0.22 | — |
| D | 112 | 88 | 0.21 | 50 |
| E | 210 | 90 | 0.24 | 51 |
| F | 280 | 220 | — | — |
| G | 270 | 30 | 0.22 | 46 |
| H | 180 | 20 | 0.41 | 36 |
| I | 260 | 10 | — | 140 |

In Table 10 the coating thickness reduction measured by a magnetic device, are shown.

TABLE 10

Coating thickness reduction

| Steel grade | Coating thickness (μm): Control flux soln + hot-dip into pure Zn | Coating thickness (μm): Innovative flux soln + hot-dip into Zn-0.03 wt % Al | Coating thickness reduction (%) |
|---|---|---|---|
| | Bath temperature: 445° C.; immersion time: 8 min | | |
| Sandelin | 90 | 70 | 22% |
| | 270 | 200 | 26% |
| | 120 | 100 | 17% |
| | 160 | 120 | 25% |
| | 90 | 70 | 22% |
| | 100 | 80 | 20% |
| Ipo-sandelin | 75 | 75 | 0% |
| | 65 | 65 | 0% |

In Table 11 is reported the visual quality assessment of coatings, according to the merit scale of Table 5.

TABLE 11

Coated quality assessment of various reactive steels, after flux into the solutions of Table 9, in 3 different Al-levels.

| Al alloying level of the Zn-based molten bath (wt %) | Flux composition | Sandelin steel: Pin-point defects | Sandelin steel: Not-coated area | Iper-sandelin steel: Pin-point defects | Iper-sandelin steel: Not-coated area | Ipo-sandelin steel: Pin-point defects | Ipo-sandelin steel: Not-coated area |
|---|---|---|---|---|---|---|---|
| 0.035 | F | ■ | ⊠ | ■ | ⊠ | ■ | ⊠ |
| | I | ○ | ⊙ | ○ | ⊙ | ○ | ⊙ |
| | E | ○ | ⊙ | ○ | ⊙ | ○ | ⊙ |
| | B | ⊙ | ⊙ | ⊙ | ⊙ | ⊙ | ⊙ |
| | D | □ | ○ | □ | ○ | □ | ○ |
| | G | ○ | ○ | ○ | ○ | ○ | ○ |
| | C | ⊙ | ⊙ | ⊙ | ⊙ | ⊙ | ⊙ |
| | B | ⊙ | ⊙ | ⊙ | ⊙ | ⊙ | ⊙ |
| | I | □ | ○ | □ | ○ | □ | ○ |
| | H | ⊙ | ⊙ | ⊙ | ⊙ | ⊙ | ⊙ |

The invention claimed is:

1. A method of batch hot-dip galvanizing steel parts, wherein the steel parts are a) degreased into an acidic aqueous 10 wt % solution, at room temperature for 10 minutes;

b) rinsed into tap-water;

c) pickled into HCl 10 wt %, at room temperature for 15 minutes;

d) rinsed into tap-water;

e) immersed into an aqueous flux solution, based on chlorides and containing bismuth chloride, said aqueous flux solution containing 50-300 g/L $ZnCl_2$, 20-300 g/L $NH_4Cl$, 0.1-1 g/L $Bi_2O_3$, 10-100 g/L KCl and having a pH between 0.5 and 1.0, adjusted by adding HCl or KOH 0.1N, and having a temperature between 3 and 50° C., the immersion time being between 10 seconds and 10 minutes;

f) dried in warm air at 60-120° C. and g) hot-dip galvanized into an alloy containing mainly zinc and 0.01 wt %-0.1 wt % of aluminium.

2. The method according to claim 1 wherein the temperature of the aqueous flux solution is between 4 and 40° C.

3. The method according to claim 2 wherein the temperature of the aqueous flux solution is between 4 and 25° C.

4. The method according to claim 1 wherein the immersion time is between 30 s and 2 min.

5. The method according to claim 4, wherein the immersion time is between 30 s and 1 min.

6. The method according to claim 1 wherein 3-7 $g/m^2$ of salts are deposited on the surface of the steel parts.

7. The method according to claim 1 wherein the steel parts are dried, after immersion in the flux solution, at 60-120° C. for a maximum time of 60 minutes.

8. The method of claim 1 wherein said flux solution has a temperature range of between 10 and 30° C.

9. The method of claim 8 wherein said flux solution has a temperature range of between 15 and 25° C.

10. The method of claim 1 wherein said immersion time is between 20 s and 2 minutes.

* * * * *